US012428938B2

(12) United States Patent
Cook et al.

(10) Patent No.: US 12,428,938 B2
(45) Date of Patent: Sep. 30, 2025

(54) PERFORATING GUN WITH SELF-ORIENTING PERFORATING CHARGES

(71) Applicant: Halliburton Energy Services, Inc., Houston, TX (US)

(72) Inventors: Jason Karl Cook, Alvarado, TX (US); Jason Paul Metzger, Alvarado, TX (US); Randall Scott Moore, Carrollton, TX (US); Matthew Craig Mlcak, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 243 days.

(21) Appl. No.: 17/692,384

(22) Filed: Mar. 11, 2022

(65) Prior Publication Data

US 2023/0212927 A1 Jul. 6, 2023

Related U.S. Application Data

(60) Provisional application No. 63/297,209, filed on Jan. 6, 2022.

(51) Int. Cl.
*E21B 43/119* (2006.01)
*E21B 17/10* (2006.01)
(Continued)

(52) U.S. Cl.
CPC ..... *E21B 43/119* (2013.01); *E21B 17/1057* (2013.01); *E21B 43/117* (2013.01); *E21B 43/118* (2013.01)

(58) Field of Classification Search
CPC .... E21B 43/119; E21B 43/117; E21B 43/116; E21B 43/118; E21B 17/1057
See application file for complete search history.

(56) References Cited

U.S. PATENT DOCUMENTS 2,664,158 A * 12/1953 Mckean ..... E21B 43/118 175/4.53
2,990,774 A * 7/1961 Toelke ..... E21B 43/118 102/310

(Continued)

FOREIGN PATENT DOCUMENTS

| | | | |
|---|---|---|---|
| EP | 2072751 | 6/2009 | |
| WO | 2015-193655 | 12/2015 | |
| WO | WO 2022067212 | * 3/2022 | ..... E21B 43/117 |

OTHER PUBLICATIONS

International Search Report and Written Opinion for Application No. PCT/US2022/021185, dated Sep. 27, 2022.

*Primary Examiner* — Yong-Suk (Philip) Ro
(74) *Attorney, Agent, or Firm* — John W. Wustenberg; C. Tumey Law Group, PLLC

(57) ABSTRACT

A perforating gun is disclosed with shaped charges at a preferential orientation. An example includes a gun body and a charge carrier disposed within the gun body. The charge carrier defines a longitudinal carrier axis and has a plurality of axially-spaced charge mounting locations. A plurality of charges are each pivotally mounted to the charge carrier at one of the respective charge mounting locations about a charge pivot axis transverse to the longitudinal carrier axis. The charges may preferentially align in response to gravity so their orientation remains constant throughout a range of inclination of the wellbore.

11 Claims, 5 Drawing Sheets

(51) Int. Cl.
*E21B 43/117* (2006.01)
*E21B 43/118* (2006.01)

(56) References Cited

U.S. PATENT DOCUMENTS

| | | | | | |
|---|---|---|---|---|---|
| 3,018,730 | A | * | 1/1962 | Castel | E21B 43/118 102/318 |
| 3,067,679 | A | * | 12/1962 | Caldwell | E21B 43/118 175/4.53 |
| 3,104,611 | A | * | 9/1963 | Baks | E21B 43/117 166/55 |
| 3,107,611 | A | * | 10/1963 | Caldwell | E21B 43/118 175/4.53 |
| 3,107,612 | A | * | 10/1963 | Caldwell | E21B 43/118 175/4.53 |
| 3,607,679 | A | * | 9/1971 | Melroy | H01G 4/40 205/171 |
| 4,961,365 | A | * | 10/1990 | Rytlewski | E21B 43/118 175/4.53 |
| 6,125,946 | A | * | 10/2000 | Chen | E21B 23/14 175/4.53 |
| 6,378,625 | B1 | | 4/2002 | Chen | |
| 6,595,290 | B2 | | 7/2003 | George et al. | |
| 8,126,646 | B2 | | 2/2012 | Grove et al. | |
| 9,127,848 | B2 | | 9/2015 | Burdett et al. | |
| 9,562,421 | B2 | | 2/2017 | Hardesty et al. | |
| 2004/0104029 | A1 | * | 6/2004 | Martin | E21B 43/11857 166/298 |
| 2006/0118303 | A1 | | 6/2006 | Schultz et al. | |
| 2009/0242198 | A1 | | 10/2009 | Evans et al. | |
| 2013/0133889 | A1 | | 5/2013 | Schacherer et al. | |
| 2017/0058648 | A1 | * | 3/2017 | Geerts | E21B 43/1185 |
| 2019/0264548 | A1 | | 8/2019 | Zhao et al. | |
| 2020/0157924 | A1 | | 5/2020 | Melhus et al. | |

* cited by examiner

PERFORATING GUN WITH SELF-ORIENTING PERFORATING CHARGES

CROSS-REFERENCE TO RELATED APPLICATIONS

The present application is a non-provisional conversion of U.S. Patent Application No. 63/297,209, filed on Jan. 6, 2022, the entire disclosure of which is incorporated herein by reference.

BACKGROUND

After drilling a subterranean wellbore, portions of the wellbore may be reinforced with a casing string that is lowered into the well and cemented in place. The casing increases the integrity of the wellbore and provides a path for producing fluids from the producing intervals to the surface. However, the casing string must be perforated within the production zone to allow formation fluids to flow into the casing.

To perforate the casing, a string of perforating guns with explosive shaped charges is lowered into the well and detonated. Upon detonation, each shaped charge creates a jet to form perforations in the casing. The perforations may extend through the casing, cement and partially into the formation. The perforations thereby serve as hydraulic openings that extend from the formation into the interior of the casing, through which formation fluids may flow into the casing.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
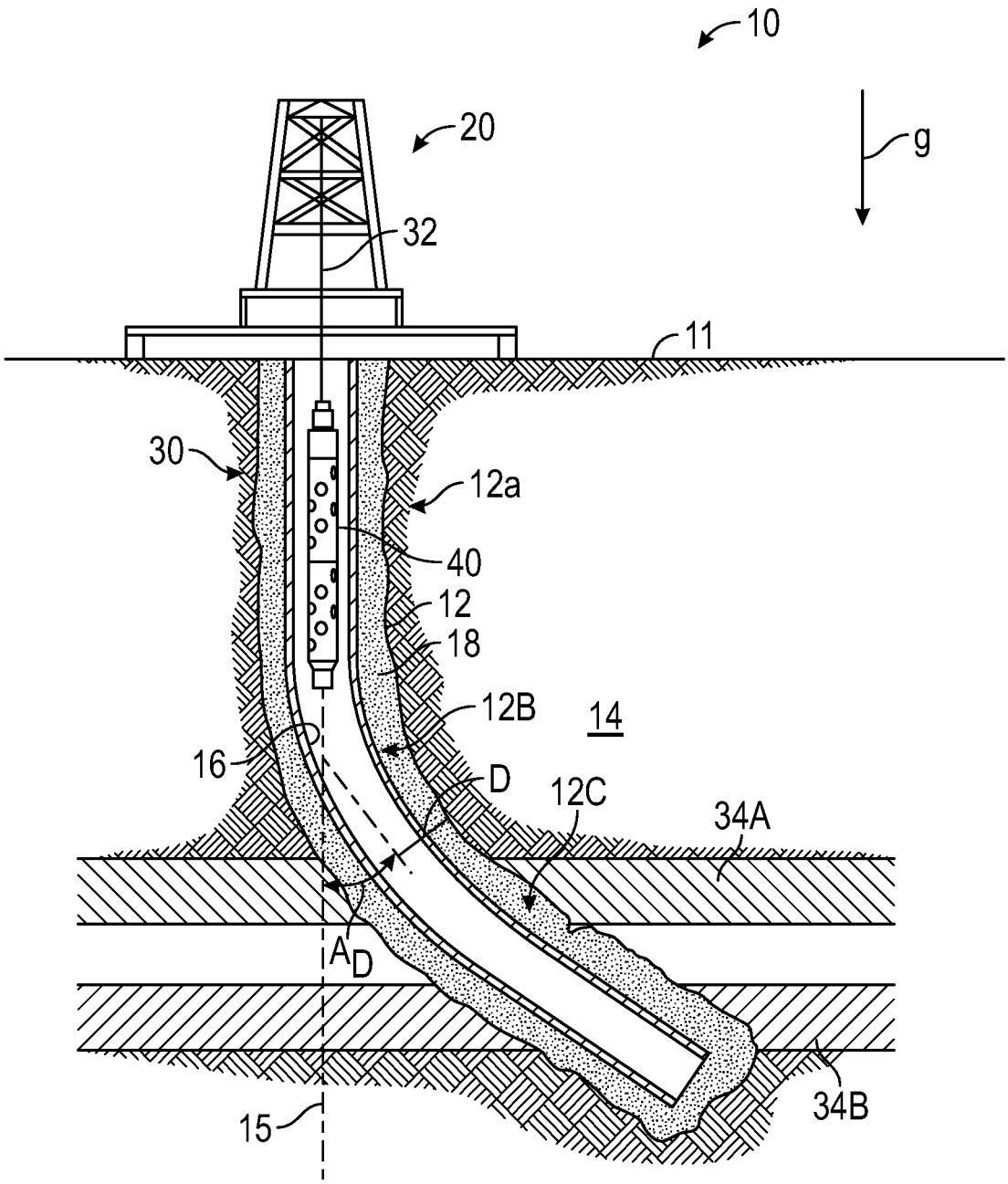
FIG. 1 is an elevation view of a representative wellsite in which a perforating gun may be deployed according to aspects of this disclosure.

A perforating gun includes shaped charges that are preferentially oriented with respect to a charge carrier inside a perforating gun body. This will allow operators to target specific locations or orientations of the formation or formation features when perforating. In some examples, a desired orientation of each of the charges may be achieved regardless of an angle of inclination of the wellbore, such as by preferentially orienting each charge with respect to a fixed reference frame, such as a gravitational and/or compass direction. For example, this may allow the perforating gun to always shoot vertically (e.g., aligned with a direction of gravity) or at some other preferred angle with respect to vertical, regardless of whether the gun string is in portion of the wellbore that is vertical, horizontal, or at an acute angle to vertical. The disclosed apparatus and methods provide flexibility to allow the gun systems to fire in directions that are not necessarily perpendicular to the top plane of the gun system. In some applications, the orientation of the charges may be aligned based on the geological structure of the surrounding formation, such as to achieve a preferred fracture orientation, reduce production of sand, etc.

In any of various embodiments, the shaped charges are pivotally mounted with respect to the charge carrier to achieve a desired orientation of the shaped charges upon firing. In some examples, the charges are self-aligning in response to gravity so their desired orientation is maintained throughout a range of inclination of the wellbore. Alternatively, the orientation of the charges may be pre-set, such as with a linkage, according to wellbore parameters known in advance, such as the inclination angle of the wellbore or structure of the surrounding geology at the zone to be perforated. In either case, the desired orientation of each charge with respect to the formation may be achieved for the specific location of the perforating gun in the wellbore. In addition to orienting each charge with respect to the charge carrier, the charge carrier itself may also be rotatably mounted within the gun body, to further achieve and maintain a preferential orientation of the charge carrier with respect to the gun body in combination with achieving and maintaining a preferential orientation of the charges with respect to the charge carrier.

In certain embodiments, one or more of the charges may be rigidly, rather than pivotally, mounted to the charge carrier at an angle other than perpendicular to a carrier axis of the charge carrier. For example, a method may include pre-positioning the charges at a fixed, non-orthogonal angle with respect to the carrier based on known parameters of a particular zone to be perforated, such as a known angle of inclination and/or known orientation of geological structures to achieve a preferred fracture orientation. Even though fixed, this ability to pre-mount charges a fixed, non-orthogonal positions allows for a custom perforating pattern. In some examples, these options may be combined. For example, some of the charges may be at a fixed angle and other charges on the same gun carrier may be pivotable about a charge pivot axis.

FIG. 1 is an elevation view of a representative wellsite 10 in which a perforating gun 40 may be deployed according to aspects of this disclosure. For ease of illustration and discussion, the wellsite 10 and its various features are simplified in some respects and not to scale. As depicted, the wellsite 10 comprises a service rig 20 that extends over and around a wellbore 12 for providing equipment and structural support for tools to be deployed into the wellbore 12. The service rig 20 may be, for example, a drilling rig, a completion rig, a workover rig, and includes a mast or other large support structure that supports a work string 30 in the wellbore 12. The service rig 20 may also comprise a derrick with a rig floor through which the work string 30 extends downward from the service rig 20 into the wellbore 12. In some cases, such as in an off-shore location, the service rig 20 may be supported by piers extending downwards to a seabed. Alternatively, the service rig 20 may be supported by columns sitting on hulls and/or pontoons that are ballasted below the water surface, which may be referred to as a semi-submersible platform or rig. In an off-shore location, a casing 16 may extend from the service rig 20 to exclude sea water and contain drilling fluid returns. It is understood that other mechanical mechanisms, not shown, may control the run-in and withdrawal of the work string 30 in the wellbore 12, for example a draw works coupled to a hoisting apparatus, another servicing vehicle, a coiled tubing unit and/or other apparatus.

The wellbore 12 penetrates a subterranean formation 14 for recovering hydrocarbons. The wellbore 12 may be drilled to any given depth, and employ directional drilling techniques to follow a desired wellbore path to reach one or more production zones, e.g., production zones 34A and/or 34B. The wellbore 12 path may, therefore, have an inclination angle with respect to a vertical axis 15 aligned with the direction of earth's gravity "g" at the wellsite 10 and azimuth about the vertical axis 15 that vary with depth. An inclination angle $A_D$ may be defined with respect to the vertical axis 15, which may vary with a depth "D" along the wellbore 12. The azimuth may be defined relative to a compass direction, e.g. polar north. In this simplified example, an initial portion 12A of the wellbore 12 extends in a vertical direction from the surface 11 of the wellsite 10. The wellbore 12 then gradually deviates at an angle to vertical along a curved portion 12B, leading to another, straight wellbore section 12C that extends through and beyond production zones 34A, 34B.

The wellbore 12 may be cased, open hole, contain tubing, and may generally be made up of a hole in the ground having a variety of shapes and/or geometries as is known to those of skill in the art. In the illustrated example, a casing 16 may be placed in the wellbore 12 and secured at least in part by cement 18. The casing 16 generally requires perforation in the vicinity of the production zones 34A, 34B in order to produce formation fluids up to the surface 11.

A number of different types of work strings are known in the art. As illustrated, the work string 30 comprises a conveyance 32 and a perforating gun 40 being lowered into the wellbore 12 on the conveyance 32. Although just one perforating gun 40 is shown a string of interconnected perforating guns may be included. The conveyance 32 may be any suitable conveyance, such as a string of pipes connected end to end, a slickline, a coiled tubing, or, as depicted in this example, a wireline. In other examples, the work string 30 may further contain one or more downhole tools (not shown in FIG. 1), for example above the perforating gun 40. The work string 30 may have one or more packers, one or more completion components such as screens and/or production valves, sensing and/or measuring equipment, and other equipment which are not shown in FIG. 1. In some contexts, the work string 30 may be referred to as a tool string. More particularly, in the context of a perforating job, the work string 30 may be referred to as a perforating string. The work string 30 may be lowered into the wellbore 12 to position the perforating gun 40 with respect to the production zones to perforate the casing 16 in the vicinity of one or more of the production zones 34.

The perforating gun 40 may be lowered into the wellbore 12 from the surface 11, gradually passing through the vertical section 12A, the curved section 12B, and the deviated section 12C. As the perforating gun 40 is lowered, the perforating gun 40 is constrained to follow the wellbore path, adopting the inclination angle (and azimuth) of the wellbore 12. Thus, the perforating gun 40 may be initially vertically oriented at its current position shown in FIG. 1. The perforating gun 40 may then tilt at an angle to vertical as it follows the wellbore path, through the curved section 12B and beyond into the deviated section 12C. The perforating gun 40 may include features to preferentially orient explosive shaped charges within the perforating gun 40, such as discussed in the example embodiments below.

Figure 2:
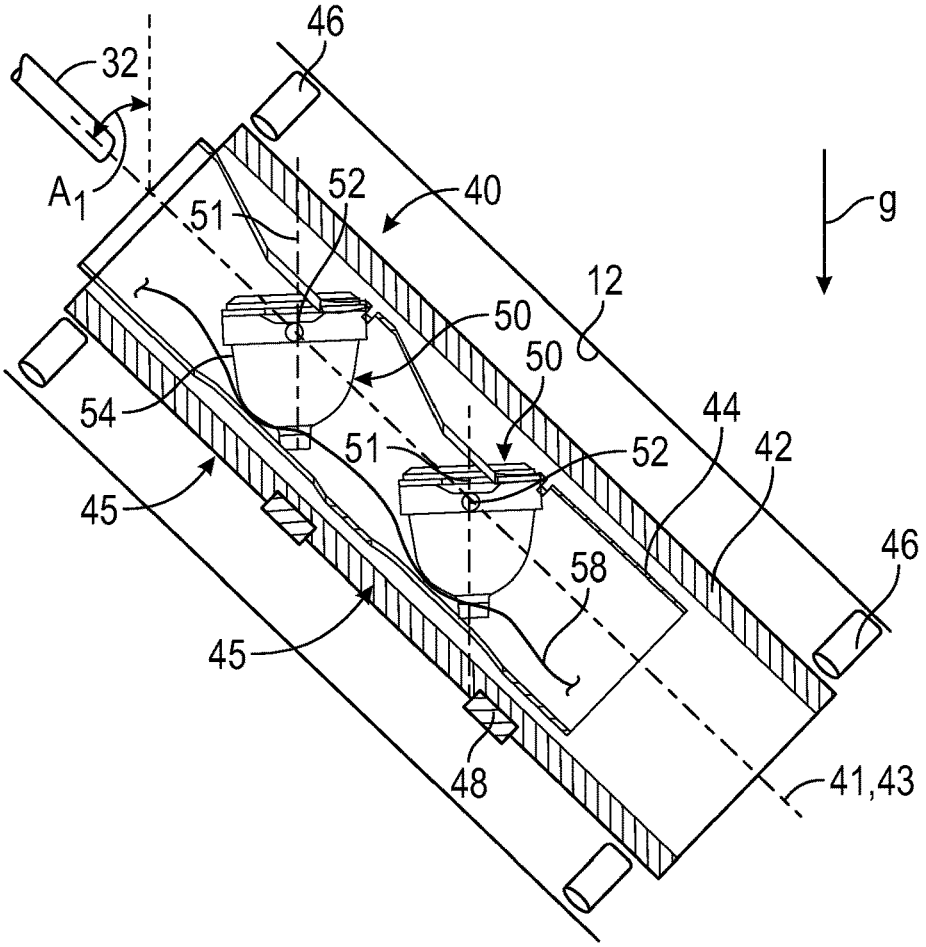
FIG. 2 is a side view of a perforating gun with self-aligning shaped charges preferentially oriented in a vertical orientation.

FIG. 2 is a side view of a portion of a perforating gun 40 with self-aligning shaped charges (alternately referred to in shorthand fashion as the "charges") 50. The charges 50 in this example are preferentially oriented in and self-aligning to a vertical direction, as may be defined with respect to (aligned with) a direction of the earth's gravity. An example of why the charges may be oriented vertically is to align with gravity if that is expected by the operator to maximize flow into the wellbore. The perforating gun 40 is positioned within a deviated section of the wellbore 12, which is at an angle $A_1$ relative to vertical. The perforating gun 40 includes a gun body 42, a charge carrier 44 disposed in the gun body 42, and a plurality of the charges 50 (two shown here) pivotally mounted to the charge carrier 44 at respective charge mounting locations 45 along the charge carrier 44. A somewhat flexible detonation cord 58 is clipped to the bottom of each charge 50 for when the perforating gun is to be fired.

The charge carrier 44 optionally comprises a tubular and/or unitary structure as shown in this example. Alternative configuration of the charge carrier 44 are also within the scope of this disclosure, such as individual charge carrier segments each holding one or more charges that may be coupled together to form a charge carrier comprising multiple charge carrier segments. The charge carrier 44 in any configuration defines a longitudinal carrier axis 41 extending through the charge carrier 44. The charges 50 are axially spaced along the charge carrier 44 with respect to the longitudinal carrier axis 41. The charge carrier 44 may be rotatably mounted within the gun body 42 about a carrier rotational axis 43, such as supported on bearings at the ends and/or along its length as schematically indicated at 46. The carrier rotational axis 43 optionally coincides with the longitudinal carrier axis 41 in this example. The charge carrier 44 may include features to preferentially orient the charge carrier 44 about the longitudinal carrier axis 41. Generally, such charge carrier alignment features may offset a center of mass of the charge carrier 44 with respect to the carrier rotational axis 43. The center of mass in at least some configurations may coincide with the longitudinal carrier axis 41. For example, the center of mass may be offset from the longitudinal carrier axis 41 with one or more weights 48 coupled to the carrier 44 radially away from the carrier rotational axis 43. The center of mass may also be offset by mounting the carrier 44 eccentrically to the gun body 42 in a way that radially offsets its center of mass with respect to the carrier rotational axis 43. Thus, the charge carrier 44 may preferentially orient itself within the gun body 42 even though the gun body 42 may rotate unpredictably as it is lowered on the conveyance 32. The charge mounting locations 45 relative to the charge carrier 44 may be selected, in part, based on the preferential orientation of the charge carrier 44.

The charges 50 shown are each pivotally mounted to the charge carrier 44 at one of the respective charge mounting locations 45 about a charge pivot axis transverse to the carrier rotational axis 43. In the view of FIG. 2, the charge pivot axis is generally orthogonal to the page, and defined by pivots 52. Each charge 50 may be weighted to preferentially orient that charge 50 about its charge pivot axis. Thus, while the charge carrier 44 may freely rotate with respect to the gun body 42 about the carrier rotational axis 43, each charge 50 may simultaneously pivot with respect to the charge carrier 44 about its pivot axis. The desired firing orientation of each charge 50 may be achieved. Optionally, one or more other charges (not shown) may be at fixed angles, which may be pre-set according to known wellbore parameters to achieve desired fracture orientations.

The gun 40 may be pre-configured so that each charge 50 preferentially aligns to a desired direction in response to gravity "g." In the example of FIG. 2, each charge 50 preferentially orients vertically in response to gravity. This vertical orientation may be achieved by having a generally symmetrical charge case 54 that defines a charge central axis 51 of each charge 50, and which generally aligns with a directional jet that each charge 50 will form. A center of mass of the charge 50 is along the charge central axis 51 in that case, and the pivots 52 are positioned along the charge central axis 51 above the center of mass, so that a net gravitational force on the charge 50 acts downward along the charge central axis 51.

The charge carrier 44 also preferentially orients with respect to the gun body 42 in response to gravity. For example, the charge carrier 44 may preferentially orient to ensure that the charges 50 point vertically upward within the plane of the page of FIG. 2 rather than being constrained to tilt at some angle transverse to the plane of the page, such as due to an inadvertent twist or rotational position of the work string within the wellbore 12.

Although the example of FIG. 2 shows both charges 50 preferentially oriented in the same direction, embodiments may be constructed so that the charges 50 preferentially orient in another, non-vertical direction. Embodiments may also be constructed so that one or more charges 50 preferentially orient in a predetermined direction that is different than the preferential orientation of other charges in the perforating gun 40.

Figure 3:
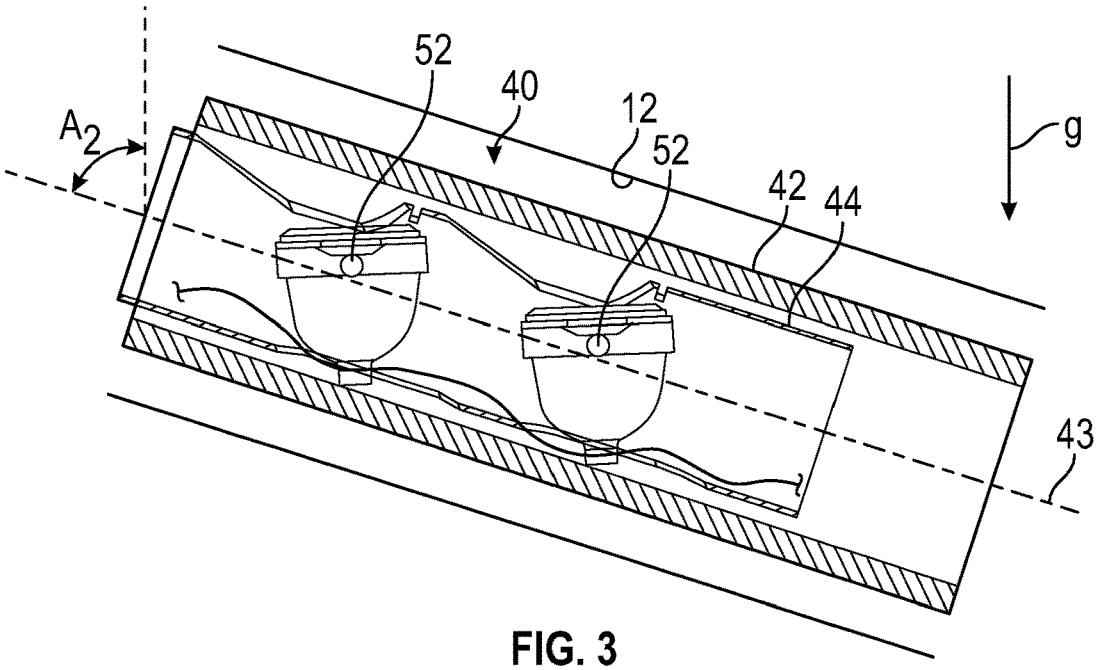
FIG. 3 is another side view of the perforating gun, wherein the self-aligning charges have maintained their vertical orientation despite a change in angle of the gun body.

FIG. 3 is a side view of a portion of the perforating gun 40, wherein the charges 50 have maintained their preferential orientation despite a change in angle of the gun body 42. The wellbore 12 in FIG. 3 is at an angle $A_2$ of greater than the angle $A_1$ of FIG. 2 (closer to horizontal by this convention). For example, the perforating gun 40 may have been moved further down into a more horizontal portion of the wellbore 12. Although the angle of the gun body 42 and gun carrier 42 has changed accordingly, the charges 50 maintain their preferential alignment by virtue of the pivoting of the charges 50 about the pivots 52 and the rotation of the charge carrier 44 about the carrier rotational axis 43.

Figure 4:
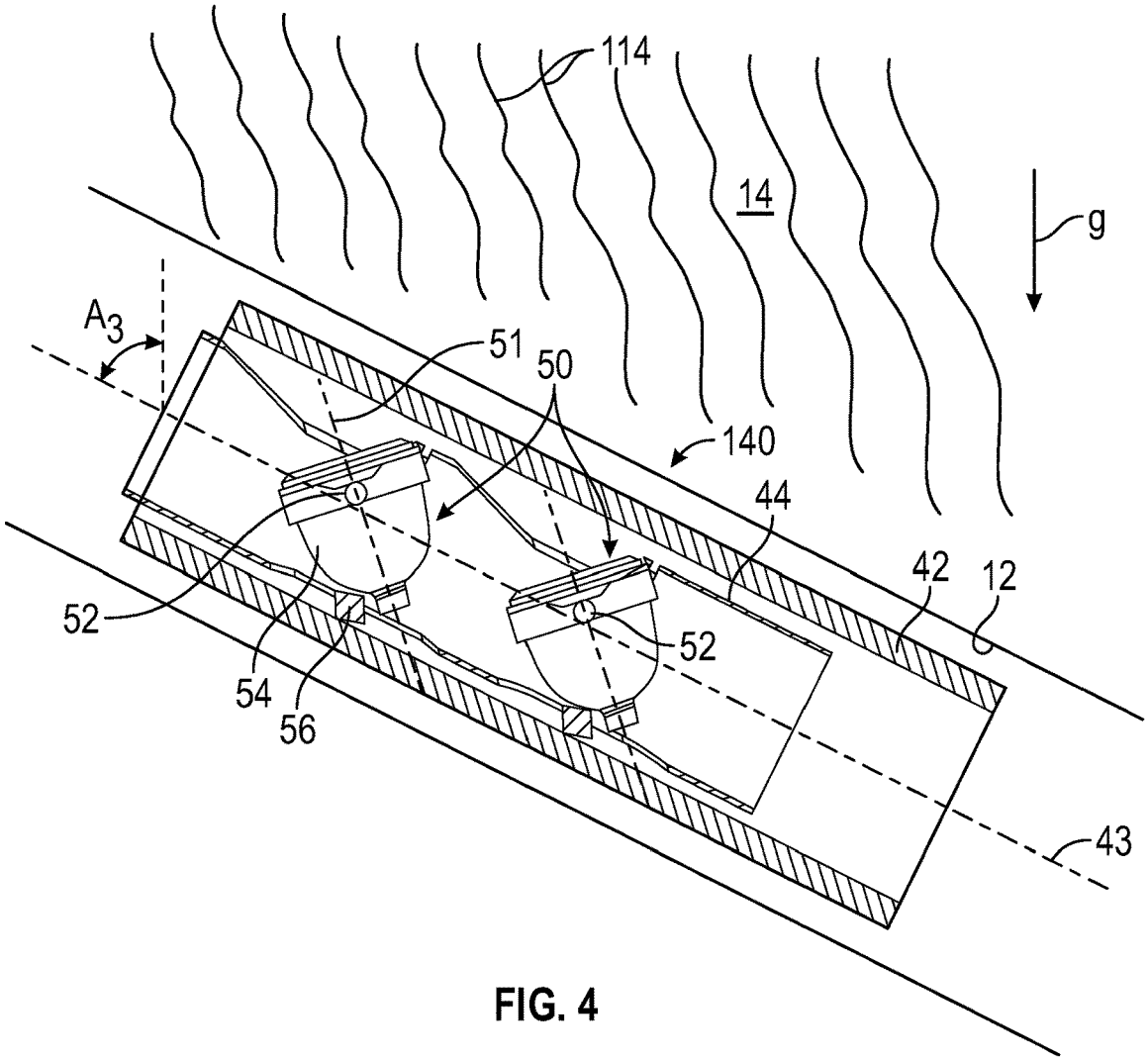
FIG. 4 is a side view of a portion of a perforating gun according to another example configuration wherein self-aligning shaped charges preferentially orient in a non-vertical orientation.

FIG. 4 is a side view of a portion of a perforating gun 140 according to another example configuration wherein the shaped charges 50 preferentially align to another, non-vertical orientation. The charges 50 may be oriented to generally align with a formation feature of the formation 14. More particularly, the formation feature in this example comprises a layered geology characterized by layers 114 that are approximately parallel to one another and at some arbitrary, non-vertical angle. The portion of the wellbore 12 shown is at an angle $A_3$ to vertical. The orientation of the layers is generally at an angle $A_5$ with respect to vertical, where $A_5$ and $A_3$ are unequal and therefore different angles with respect to vertical. If the charges 50 were conventionally oriented perpendicular to the carrier axis 43 they would fire in a direction transverse to the orientation of the layers 114. In this example, the charges 50 are instead preferentially oriented about their pivots 52, so that the charges 50 will fire in a direction generally aligned with the non-vertical orientation of the layers 114. As a non-limiting example, this preferential orientation may be expected to improve flow rate of hydrocarbons from the formation 14 into the well by aligning the perforations with the natural orientation of the layers 114 at this particular location in the formation 14.

Each charge 50 is again pivotally mounted to the charge carrier 44 about a charge pivot axis defined by pivots 52. Each charge 50 may be weighted to preferentially orient that charge 50 about its charge pivot axis. More particularly, to achieve a non-vertical orientation in this example, the charges 50 may be weighted and/or mounted to offset their centers of mass with respect to the charge central axis 51. This is schematically depicted in FIG. 4 with weights 56, but could also be achieved with an asymmetric outer portion of the charge case 54 and/or by radially offsetting the pivots 52 from the charge central axis 51. Thus, the charge carrier 44 may still freely rotate with respect to the gun body 42 about the carrier rotational axis 43, while each charge 50 simultaneously orients about the pivots 52. In the example of FIG. 4, each charge 50 preferentially orients vertically in response to gravity "g" but this time to a non-vertical direction.

Figure 5:
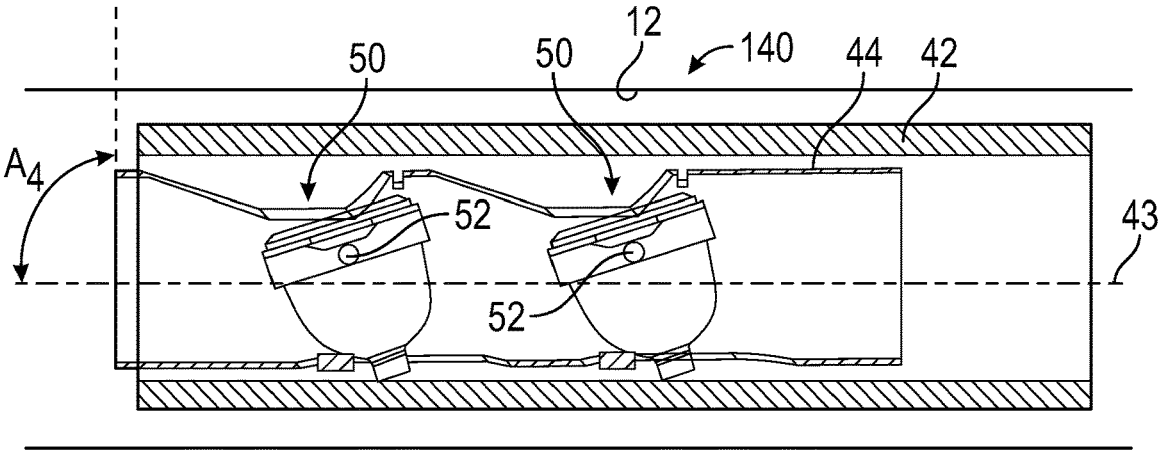
FIG. 5 is a side view of a portion of the perforating gun of FIG. 4, wherein the self-aligning charges have maintained their preferential alignment despite a change in angle of the gun body.

FIG. 5 is a side view of a portion of the perforating gun 140 of FIG. 4, wherein the charges 50 have maintained their preferential alignment despite a change in angle of the gun body 42. The wellbore 12 is now at an angle $A_4$ of greater than the angle $A_3$ of FIG. 4 (nearly horizontal in this case). For example, the perforating gun 140 may have been moved further down into the wellbore 12 where the wellbore 12 is now in a more horizontal orientation at this depth. Although the angle of the gun body 42 and the gun carrier 44 has changed accordingly, the charges 50 maintain their preferential alignment, by virtue of the pivoting of the charges 50 about the pivots 52 and the rotation of the charge carrier 44 about the carrier rotational axis 43.

Figure 6:
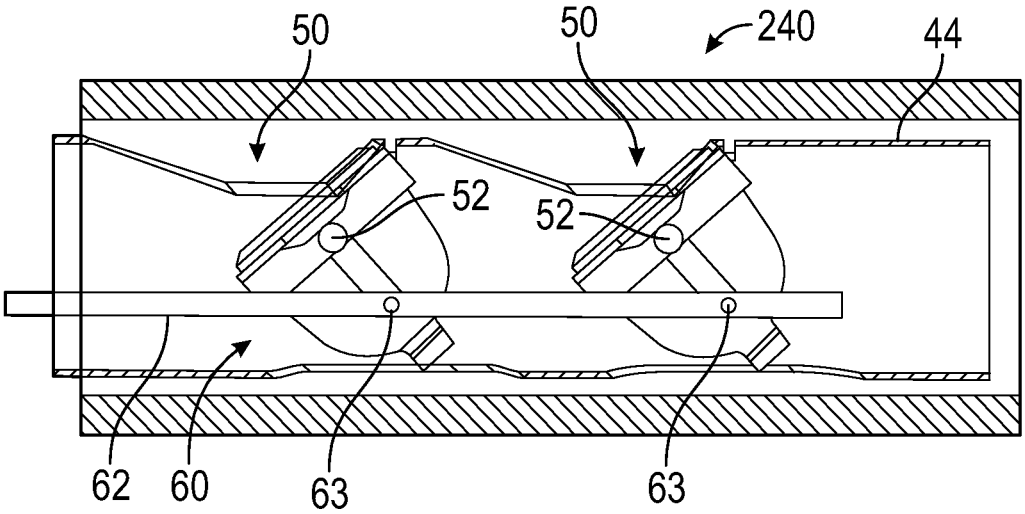
FIG. 6 is a side view of a perforating gun according to another embodiment wherein the orientation of the charges is governed by a linkage.

FIG. 6 is a side view of a perforating gun 240 according to another embodiment wherein the orientation of the charges 50 with respect to the gun carrier 44 is governed by a linkage generally indicated at 60. The linkage 60 in this example comprises a link 62 that is coupled to at least the two charges 50 shown. The link 62 is coupled to the charges 50 at coupling locations 63 offset from the pivots 52. The link 62 may also be coupled to other charges (not shown) in the same perforating gun 240. The link 62 may be sufficiently rigid so that movement of the link 62 simultaneously moves all of the charges 50 to which the link 62 is coupled. The link 62 is depicted by way of example as a straight rod, although alternative link shapes may perform the same function of pivoting the charges 50. Thus, the link is moveable to simultaneously adjust a pivot angle of the charges 50 about their pivot axes defined by their pivots 52.

In the example of FIG. 6, the coupling locations 63 at which the link 62 is coupled to each charge is at the same relative locations, to position all of the charges 50 at the same pivot angle. In an alternative embodiment, the link 62 may be coupled to different relative locations of the two charges 50, so that although the link 62 moves the two charges 50 together, the charges 50 remain at different pivot angles. In another embodiment, the linkage 60 may comprise a plurality of links 62, where each link 62 is coupled to a different subset of the charges 50. For example, a perforating gun with eight charges may include a first link coupling four of the eight shaped charges and a second link coupling the other four of the eight charges.

Figure 7:
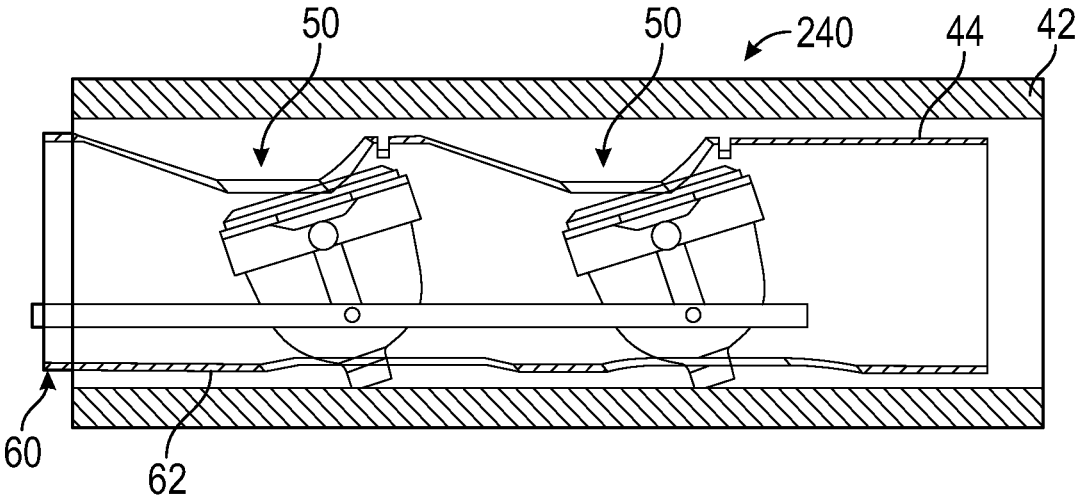
FIG. 7 is a side view of the perforating gun of FIG. 6, wherein the link has been shifted longitudinally to simultaneously adjust the pivot angles of the shaped charges.

FIG. 7 is a side view of the perforating gun 240 of FIG. 6, wherein the link 62 of the linkage 62 has been shifted longitudinally within the charge carrier 44 and the gun body 42 to move both charges 50 shown from a first pivot angle of FIG. 6 to the different pivot angle of FIG. 7. Again, in this example, both charges 50 shown are at the same relative pivot angle in FIG. 7. The embodiment of FIGS. 6 and 7 is particularly useful, for example, when a portion of the wellbore to be perforated is at a known angle of deviation relative to vertical. Whether the desired firing orientation of the charges 50 is also vertical, or at some non-vertical angle, the linkage 60 may be used to set the charges to a pivot angle that will achieve the desired firing orientation.

In the foregoing examples the charges were pivotally mounted to the charge carriers. In certain embodiments, one or more of the charges may be rigidly, rather than pivotally, mounted to the charge carrier at an angle other than perpendicular to a carrier axis of the charge carrier.

Figure 8:
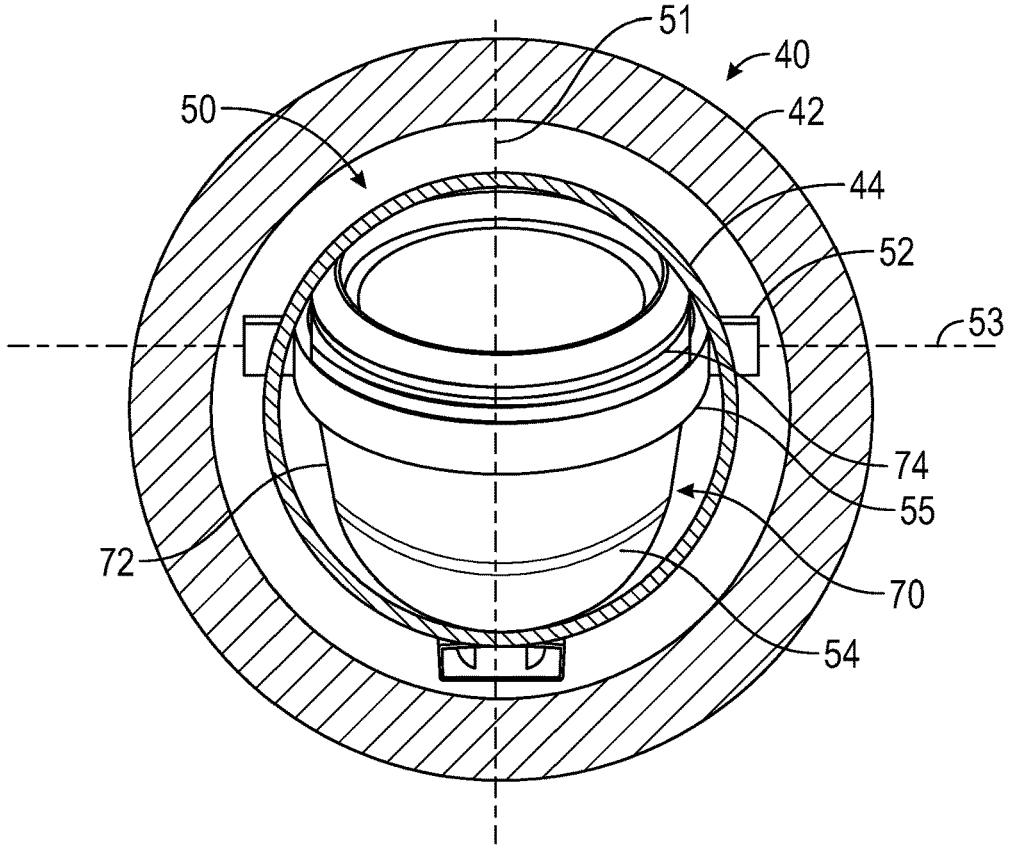
FIG. 8 is an end view of the perforating gun with the charge carrier preferentially oriented vertically.

FIG. 8 is an end view of the perforating gun 40. The charge carrier 44 is generally tubular in this example and centrally mounted within the gun body 42. The pivot axis 53 is within a plane of the page of FIG. 8 and passes through the pivots 52 at either end of the charge 50, at which the charge 50 is pivotally mounted to the charge carrier 44. The rotational position of the charge carrier 44 is such that the charge central axis 51 is in a vertical plane, even though the charge central axis 51 is tilted out of the page in this view (not fully vertical).

FIG. 8 further illustrates an example gimble mount 70 for pivotally mounting the charge 50. One of these gimble mounts 70 may be included at each of the plurality of charge mounting locations on the charge carrier 44. In this example, the gimble mount 70 includes a collar 72 for removably receiving a respective one of the charges 50. The collar 72 supports the charge 50 along a periphery of the charge case 54. The collar 72 may be flexible, wherein the received charge 50 adds rigidity to the gimble mount 70. The pivots 52 may extend from or to the collar 72 to pivotally support the collar 72 on the charge carrier 44, and correspondingly to pivotally mount the charge to the charge carrier 44. The gimble mount 70 also includes a gimble lip 74 that may include features for securing the respective charge in the gimble. The gimble lip 74 is a region at the top edge of the collar 72 where the bottom of the charge case rib 55 may rest. Each gimble mount 70 may releasably accommodate each charge 50 using a twist lock, cam lock, bend tab, or other suitable retainer and/or connection, which may be provided on, between, or near the gimble lip 74 and/or the charge case rib 55. The twist lock is part of the charge is the larger OD portion that is sitting on collar 72. In the illustrations, there are two flats on opposing sides of the charge, which in this representation may be a twist lock. The cam feature, if used, may be in the same location.

Figure 9:
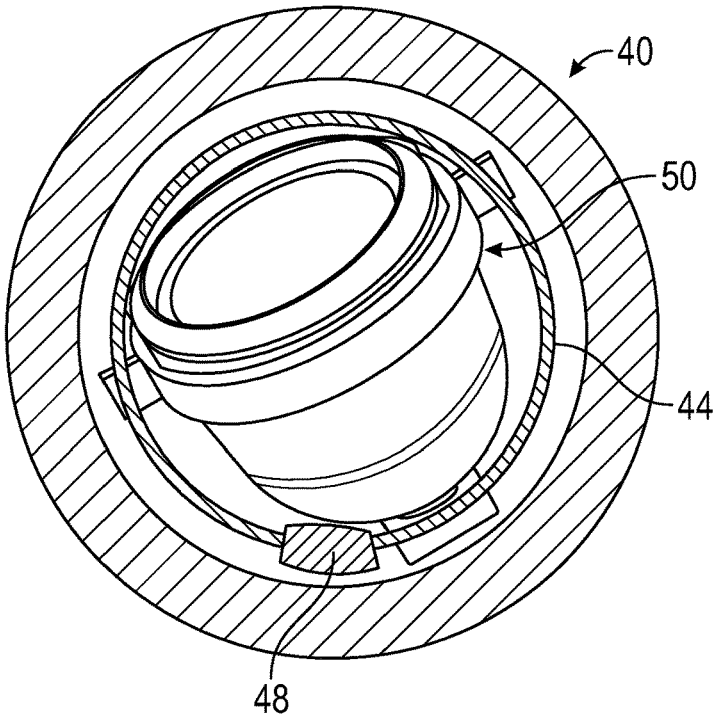
FIG. 9 is an end view of the perforating gun in another example wherein the charge carrier is preferentially oriented in a non-vertical direction

FIG. 9 is an end view of the perforating gun 40 in another example wherein the charge carrier 44 is oriented in a non-vertical direction. The charge carrier 44 may be preferentially aligned to this orientation in response to gravity, such as with weights 48 or by offsetting the rotational axis as described above. The charge 50 is also oriented relative to the charge carrier 44 in a non-vertical direction. Alternatively, a linkage (e.g., example of FIGS. 6-7) may be used to urge the charges 50 to predetermined orientations. Again, the preferential orientation of the charge carrier 44 and the preferential or predetermined orientation of the charge 50 may be selected according to known wellbore parameters, such as inclination angle or structure of the surrounding geology, and so forth.

The disclosed apparatus in any of its forms, including but not limited to the example apparatus set forth above, may be used in a perforating method. In one example, a method of perforating a well comprises lowering a plurality of charges into a wellbore at a plurality of axially-spaced charge mounting locations on a charge carrier. The charge carrier may be rotatably supported on a gun body about a carrier rotational axis, which may coincide with or be offset from a longitudinal carrier axis. The charges may be pivotally mounted to the charge carrier about a charge pivot axis that is transverse to the longitudinal carrier axis. The method may further include pivoting one or more of the charges about its respective charge pivot axis to maintain a preferential orientation of each of the one or more charges. Thus, the preferential orientation of the one or more shaped charges may be maintained as an angle of the wellbore changes such as when lowering the perforating gun into a deviated wellbore.

The step of individually pivoting each charge to maintain a preferential orientation may comprise applying a weight to each charge case at a location offset from the charge pivot axis. The weight may be centered along a centerline of the charge case to maintain a vertical orientation. Alternatively, the weight may be offset from the centerline of the charge case to maintain a non-vertical orientation. The charge carrier and the charges may be preferentially oriented in response to gravity. Alternatively, the charges may be urged to a selected pivot angle by a linkage coupling two or more of the charges. The method may entail simultaneously adjusting a pivot angle of each charge about their pivot axes using a link coupled to each charge at a location offset from the pivot axis. Optionally, the link may be coupled to each charge at the same relative locations to position all of the charges at the same pivot angle.

An alternate method may include pre-positioning the charges at a fixed, non-orthogonal angle with respect to the carrier based on known parameters of a particular zone to be perforated, such as a known angle of inclination and/or known orientation of geological structures to achieve a preferred fracture orientation. Even though fixed, this ability to pre-mount charges a fixed, non-orthogonal positions allows for a custom perforating pattern. In some examples, these options may be combined. For example, some of the charges may be at a fixed angle and other charges on the same gun carrier may be pivotable about a charge pivot axis.

Accordingly, the present disclosure comprises various apparatus, systems, and methods using shaped charges that are preferentially oriented with respect to a charge carrier inside a perforating gun body. Embodiments may include any of the various features disclosed herein, including but not limited to one or more of the following statements.

Statement 1. A perforating gun, comprising: a gun body; a charge carrier disposed within the gun body, the charge carrier defining a longitudinal carrier axis and having a plurality of axially-spaced charge mounting locations; and one or more charges each pivotally mounted to the charge carrier at one of the respective charge mounting locations about a charge pivot axis transverse to the longitudinal carrier axis.

Statement 2. The perforating gun of Statement 1, wherein each charge is preferentially oriented about its charge pivot axis with respect to a direction of gravity.

Statement 3. The perforating gun of Statement 2, wherein each charge is preferentially oriented vertically in response to gravity.

Statement 4. The perforating gun of Statement 2, wherein each charge is preferentially oriented at a non-vertical angle in response to gravity.

Statement 5. The perforating gun of Statement 1, wherein the charge carrier is rotatably mounted within the gun body about a carrier rotational axis longitudinally extending through the charge carrier.

Statement 6. The perforating gun of Statement 5, wherein a center of mass of the charge carrier is offset from the carrier rotational axis to preferentially orient the charge carrier about the carrier rotational axis.

Statement 7. The perforating gun of Statement 1, further comprising:

a linkage comprising a link coupled to a plurality of the charges, wherein the link is moveable to simultaneously adjust a pivot angle of the charges about their pivot axes.

Statement 8. The perforating gun of Statement 7, wherein the link is coupled to each charge at the same relative locations to position all of the charges connected by the connecting rod at the same pivot angle.

Statement 9. The perforating gun of Statement 1, further comprising: a gimble mount at each of the plurality of charge mounting locations, each gimble mount for receiving and pivotally mounting one of the charges to the charge carrier.

Statement 10. The perforating gun of Statement 9, wherein each gimble mount comprises a gimble lip for securing the respective charge in the gimble.

Statement 11. The perforating gun of Statement 10, wherein each gimble mount releasably accommodates the respective charge using a twist lock, cam lock, or bend tab.

Statement 12. The perforating gun of Statement 9, wherein each gimble mount comprises a flexible collar for supporting a periphery of the respective charge, wherein the received charge adds rigidity to the gimble mount.

Statement 13. A perforating gun, comprising: a gun body; a charge carrier defining a longitudinal carrier axis and having a plurality of axially-spaced charge mounting locations, wherein the charge carrier is rotatably mounted within the gun body about the carrier rotational axis and weighted to preferentially orient the charge carrier about the carrier rotational axis; and a gimble mount at each of the plurality of charge mounting locations, each gimble mount for receiving and pivotally mounting one of the charges to the charge carrier about a charge pivot axis transverse to the longitudinal carrier axis, wherein each charge is weighted to preferentially orient the charge about its charge pivot axis.

Statement 14. A method of perforating a well, comprising: lowering a plurality of charges into a wellbore at a plurality of axially-spaced charge mounting locations on a charge carrier defining a longitudinal carrier axis; and tilting one or more of the charges to a preferential orientation with respect to the longitudinal carrier axis according to an inclination angle of the wellbore at which the charges are to be fired.

Statement 15. The method of Statement 14, wherein tilting the one or more of the charges to the preferred orientation comprises pivoting the one or more of the charges about a respective charge pivot axis transverse to the longitudinal carrier axis to maintain the preferential orientation of each of the one or more charges as the inclination angle of the wellbore changes during the lowering.

Statement 16. The method of Statement 15, wherein individually pivoting each charge to maintain a preferential orientation comprises applying a weight to each charge case at a location offset from the charge pivot axis.

Statement 17. The method of Statement 16, further comprising applying a weight to each charge case at a location centered along a centerline of the charge case to preferentially orient each charge vertically.

Statement 18. The method of Statement 16, further comprising applying a weight to each charge case at a location offset from a centerline of the charge case to preferentially orient each charge in a non-vertical direction.

Statement 19. The method of Statement 15, further comprising: preferentially orienting the charge carrier about the longitudinal carrier axis in response to gravity.

Statement 20. The method of Statement 15, further comprising: simultaneously adjusting a pivot angle of each charge about their pivot axes using a link coupled to each charge at a location offset from the pivot axis.

What is claimed is:

1. A perforating gun, comprising:

a gun body;

a charge carrier disposed within the gun body, the charge carrier defining a longitudinal carrier axis and having a plurality of axially-spaced charge mounting locations; and one or more charges each pivotally mounted to the charge carrier at one of the respective charge mounting locations, wherein each charge mounting location is disposed about a respective charge pivot axis defined by a corresponding pivot, wherein each charge pivot axis is transverse to the longitudinal carrier axis, and wherein each charge of the one or more charges is configured to pivot about their respective charge pivot axis to maintain a vertical fining orientation, with respect to a direction of gravity in response to gravity.

2. The perforating gun of claim 1, wherein the charge carrier is rotatably mounted within the gun body about a carrier rotational axis longitudinally extending through the charge carrier.

3. The perforating gun of claim 2, wherein a center of mass of the charge carrier is offset from the carrier rotational axis to preferentially orient the charge carrier about the carrier rotational axis.

4. The perforating gun of claim 1, further comprising:

a linkage comprising a link coupled to a plurality of the charges, wherein the link is moveable to simultaneously adjust a pivot angle of the charges about their respective charge pivot axes.

5. The perforating gun of claim 4, wherein the link is coupled to each charge at the same relative locations to position all of the charges connected by the connecting rod at the same pivot angle.

6. The perforating gun of claim 1, further comprising:

a gimble mount at each of the plurality of charge mounting locations, each gimble mount for receiving and pivotally mounting one of the charges to the charge carrier.

7. The perforating gun of claim 6, wherein each gimble mount comprises a gimble lip for securing the respective charge in the gimble.

8. The perforating gun of claim 7, wherein each gimble mount releasably accommodates the respective charge using a twist lock, cam lock, or bend tab.

9. The perforating gun of claim 6, wherein each gimble mount comprises a flexible collar for supporting a periphery of the respective charge, wherein the received charge adds rigidity to the gimble mount.

10. The perforating gun of claim 1, wherein each charge of the one or more charges includes a symmetrical charge case that defines a charge central axis of each charge, wherein the charge central axis is generally aligned with a directional jet formed by each charge in response to detonation, wherein a center of mass of each charge is disposed along their respective charge central axis, and wherein the corresponding pivot of each charge is positioned along their respective charge central axis between the center of mass and a firing end of each charge.

11. The perforating gun of claim 1, wherein a center of mass of the charge carrier is radially offset with respect to a carrier rotational axis of the charge carrier, wherein the charge carrier is configured to rotate with respect to the gun body in response to gravity.

* * * * *